United States Patent [19]

Goldberg et al.

[11] 4,217,663

[45] Aug. 19, 1980

[54] VEST

[76] Inventors: David B. Goldberg, 3017 Greenleaf, Wilmette, Ill. 60091; J. W. Baker, 709 Alexander St., Paris, Ill. 60704

[21] Appl. No.: 49,646

[22] Filed: Jun. 18, 1979

[51] Int. Cl.[2] ..... A41D 1/04; A41D 3/02

[52] U.S. Cl. ..... 2/102; 2/86

[58] Field of Search ..... 2/102, 86, 108, 95, 2/97, 126, 94

[56] References Cited

U.S. PATENT DOCUMENTS

| | | | |
|---|---|---|---|
| 672,729 | 4/1901 | Conley | 2/95 |
| 2,316,983 | 4/1943 | Wulf | 2/97 |
| 3,389,407 | 6/1968 | Morrison | 2/86 |
| 4,006,495 | 2/1977 | Jones | 2/126 |

*Primary Examiner*—Doris L. Troutman

*Attorney, Agent, or Firm*—George H. Gerstman

[57] ABSTRACT

An outerwear garment is provided which comprises a sleeveless vest having a kidney extension flap at its lower back portion. The kidney extension flap has an interior portion which defines a pouch. A jacket having sleeves is connected to the lower portion of the vest adjacent the pouch. The jacket may be inserted into the pouch when the vest is worn in a sleeveless mode without the jacket, or the jacket may be withdrawn from the pouch and the jacket's sleeves may be inserted through side openings defined by the vest.

13 Claims, 6 Drawing Figures

VEST

BACKGROUND OF THE INVENTION

This invention concerns a novel outerwear garment, and, more particularly, a novel sleeveless vest that can rapidly be adapted for use as a sleeved garment.

Sleeveless vests have become very popular and are generally used in moderately cold weather, particularly where freedom of arm movement is desirable. Such sleeveless vests may comprise an outer layer and an inner lining surrounding filler material such as down or other filler materials which are well-known in the art.

Often, the sleeveless vest is not satisfactory for suitable warmth, and it is necessary that the vest be worn over a shirt, or a jacket, or another article of clothing which combined with the vest will provide suitable warmth to the upper body. As used herein, the terms "shirt" and "jacket" are intended to designate any garment having sleeves for wearing on the upper body.

It is an object of the present invention to provide an outerwear garment which may be used as a sleeveless vest or may selectively be used with sleeves and additional portions for greater warmth.

Another object of the present invention is to provide an outerwear garment in the general form of a sleeveless vest but further including a kidney extension flap which serves as a pouch to carry a connected jacket portion.

A further object of the present invention is to provide an outerwear garment that is relatively lightweight but provides significant warmth in a selective manner.

Other objects and advantages of the present invention will become apparent as the description proceeds.

SUMMARY OF THE INVENTION

In accordance with the present invention, an outerwear garment is provided which includes a sleeveless vest for surrounding the upper body. The vest comprises a back portion, a front portion and closure means for closing the front portion. The lower interior of the back portion of the vest defines a pouch.

A jacket is provided with its lower end being connected to the vest adjacent to the pouch. The jacket may selectively surround the upper body and comprises a back jacket portion, a front jacket portion, a pair of sleeves and means for closing the front jacket portion.

The jacket may be inserted into the pouch or the jacket may be withdrawn from the pouch with the jacket sleeves being inserted through side openings that are defined by the sleeveless vest.

In the illustrative embodiment, a kidney extension flap is provided and is contiguous with the back portion of the vest. An inner kidney flap layer is connected to the lower end of the jacket to form the pouch which is defined by the inner kidney flap layer and the inside of the kidney extension flap.

A more detailed explanation of the invention is provided in the following description and claims, and is illustrated in the accompanying drawings.

DETAILED DESCRIPTION OF THE ILLUSTRATIVE EMBODIMENT

Figure 1:
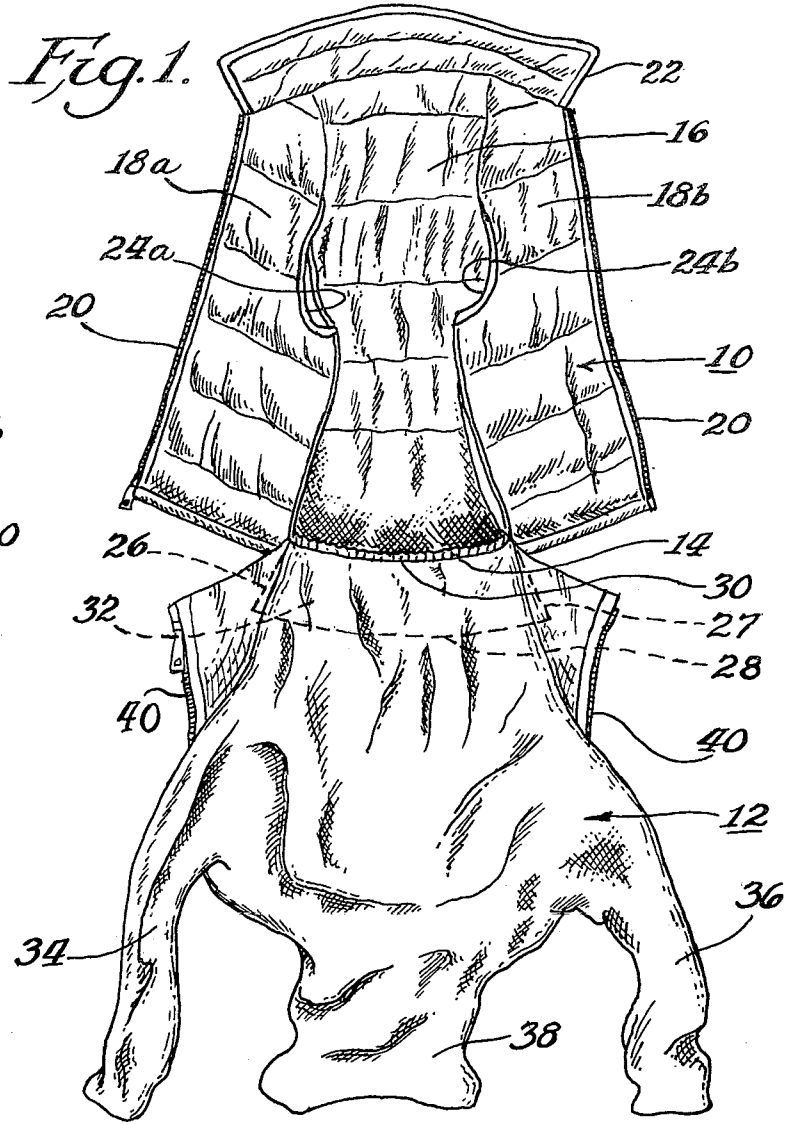
FIG. 1 is a view of an outerwear garment constructed in accordance with the principles of the present invention.
Figure 2:
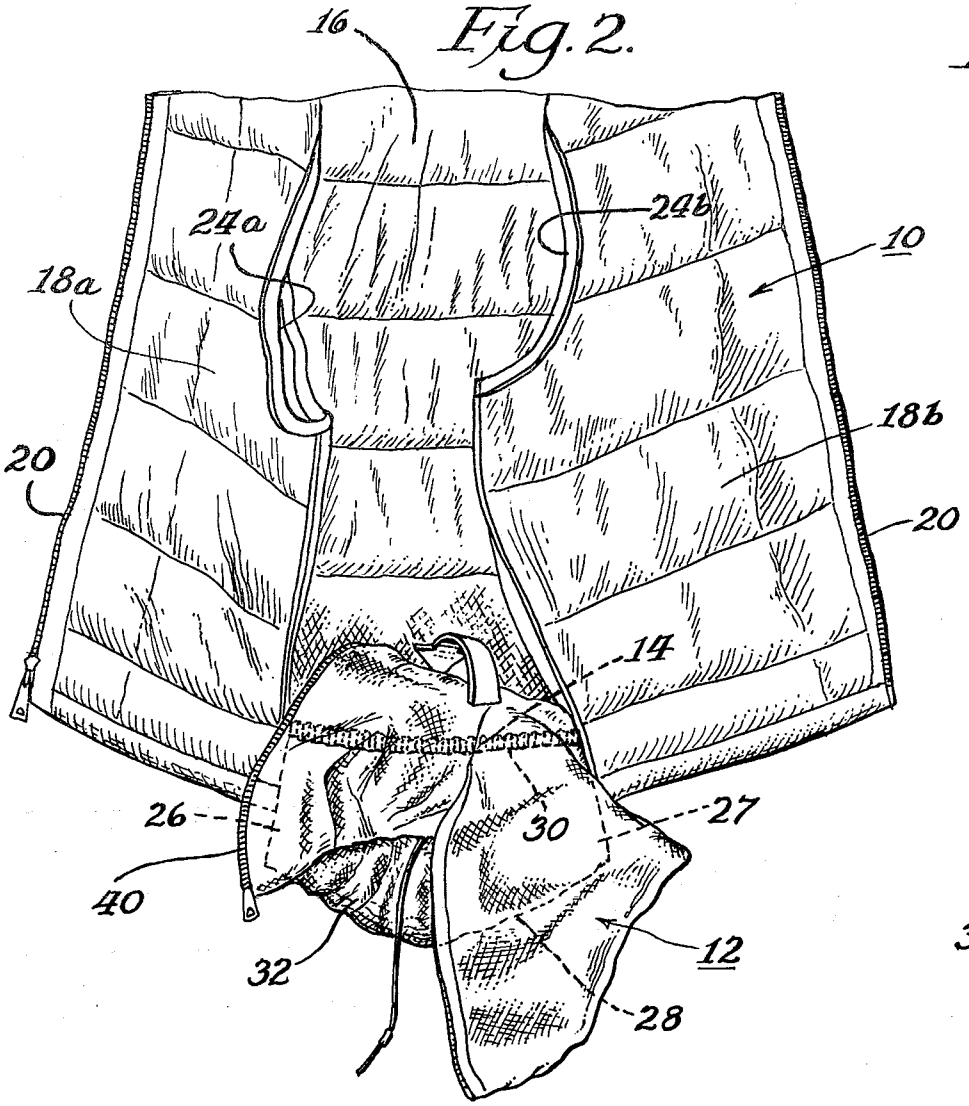
FIG. 2 is a view similar to the view of FIG. 1, but showing the jacket being inserted into the pouch.

Referring to FIGS. 1 and 2 in particular, the outerwear garment shown therein comprises a sleeveless vest 10 and a jacket 12, joined by an elastic member 14.

In FIG. 1, the inside of vest 10 is illustrated, with the vest including a back portion 16, a front portion **18*a*, 18*b* with a zipper 20 for closing front portion 18*a*, 18*b*. A collar 22** is also provided.

As is typical with sleeveless vests, armholes **24*a* and 24*b* are defined at the intersection of back portion 16 and front portions 18*a*, 18*b*. The vest is preferably of the insulated type, having an outer layer formed of nylon, cotton or a nylon-cotton mixture, an inner lining also formed of nylon or cotton or a nylon-cotton mixture, and a filling material such as down or polyester. Vest 10** is preferably quilted horizontally as illustrated, and one or more pockets may be provided.

Vest 10 also includes a kidney extension flap 26, which extends from the bottom of back portion 16 and is adapted to cover the portion at the base of the wearer's back when the vest is worn. The kidney extension flap 26 has an outer layer that is contiguous with the outer layer of the vest 10 and also an inner lining that is contiguous with the inner lining of vest 10 to enclose filler material. Kidney extension flap 26 is provided with an inner layer 27 that extends up from bottom 28 and is joined at 30 with the bottom of jacket 12. Joint 30 is preferably formed of an elastic material and a pouch 32 is defined by the inner lining of the kidney extension flap 26 and inner layer 27 thereof, with the elastic member 30 forming a portion of the mouth of pouch 32.

Jacket 12 may be formed of nylon or cotton or a nylon-cotton mixture and includes a main body portion with a pair of sleeves 34, 36 and a connected hood 38. A zipper 40 is provided to close the jacket while it is being worn.

As illustrated in FIG. 2, jacket 12 may be folded and inserted in pouch 32, with the vest 10 being worn as a sleeveless vest. In this manner, the jacket 12 itself, within pocket 32, will provide an extra snugness and insulation for the wearer at the location where the kidney extension flap lies. It has been found that the outer garment of the present invention is very comfortable with the jacket 12 being tucked inside pocket 32, with the kidney extension flap giving extra warmth against vital areas.

When the wearer wishes to cover his upper body with both the jacket 12 and vest 10, the jacket 12 is removed from pocket 32 and sleeves 34 and 36 are inserted, respectively, through openings **24*a* and 24*b*. The wearer may then introduce his arms into sleeves 34 and 36 of jacket 12 in the normal manner and he will automatically be also wearing vest 10. Zipper 40 may be selectively closed to close the front of jacket 12 and zipper 20 of vest 10 may be selectively closed to close the front portion of vest 10. Further, hood 38, which is carried by jacket 12**, may be worn if desired.

Figure 3:
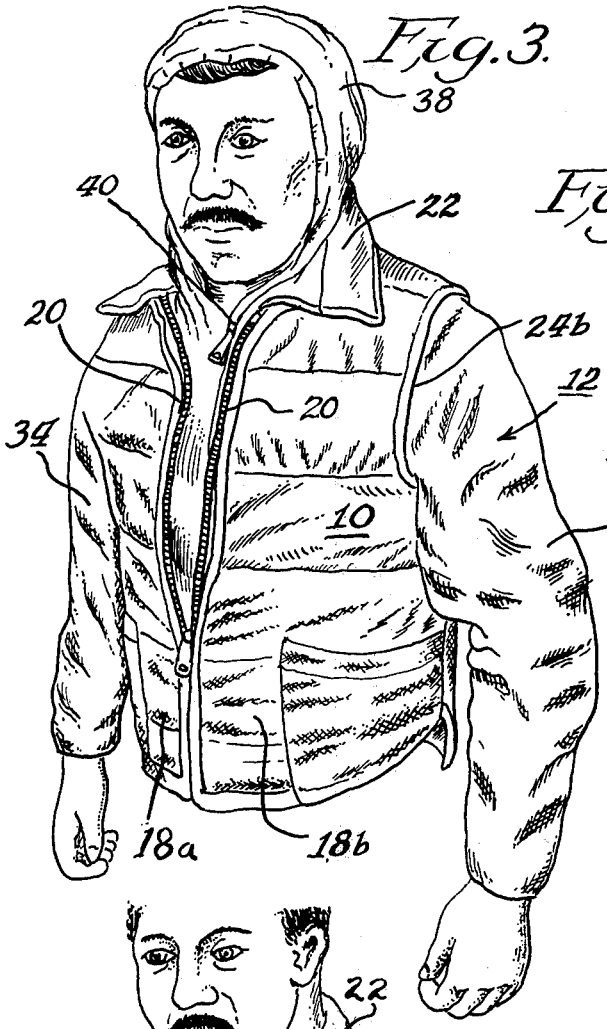
FIG. 3 is a perspective view of the upper portion of a man wearing the garment of FIG. 1, with the vest and connected jacket both being worn.
Figure 4:
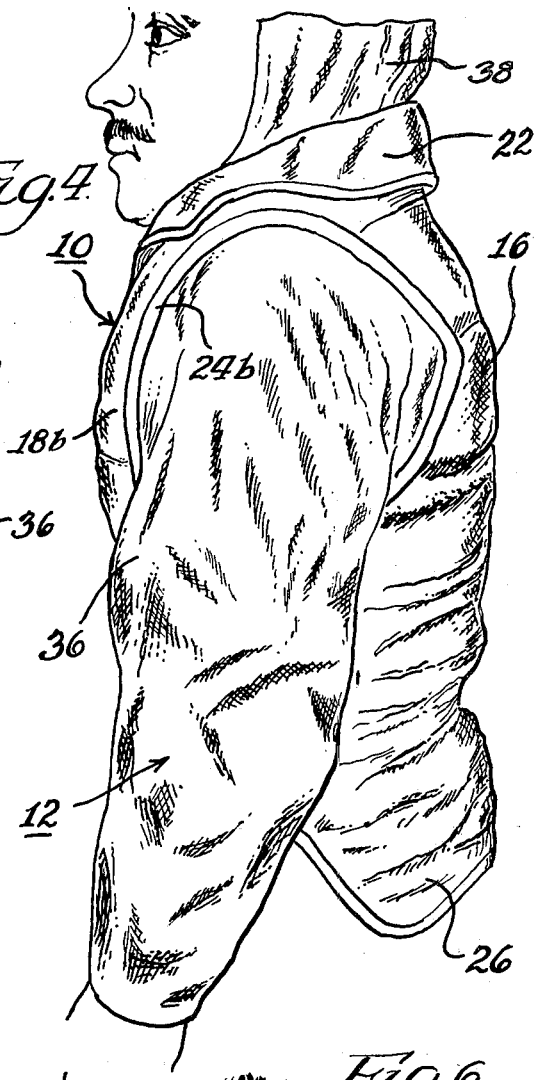
FIG. 4 is a side view thereof.
Figure 5:
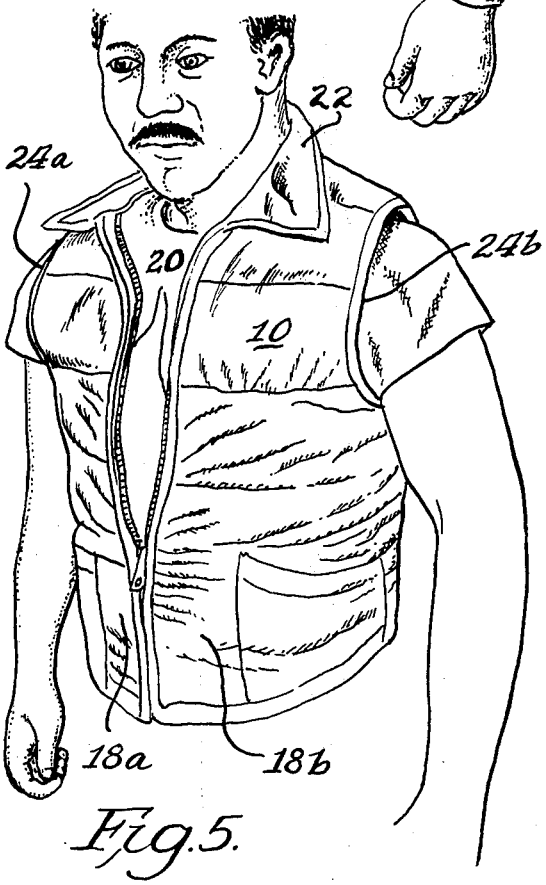
FIG. 5 is a perspective view of the upper portion of a man wearing the garment of FIG. 1, with the jacket being inserted in the pouch.
Figure 6:
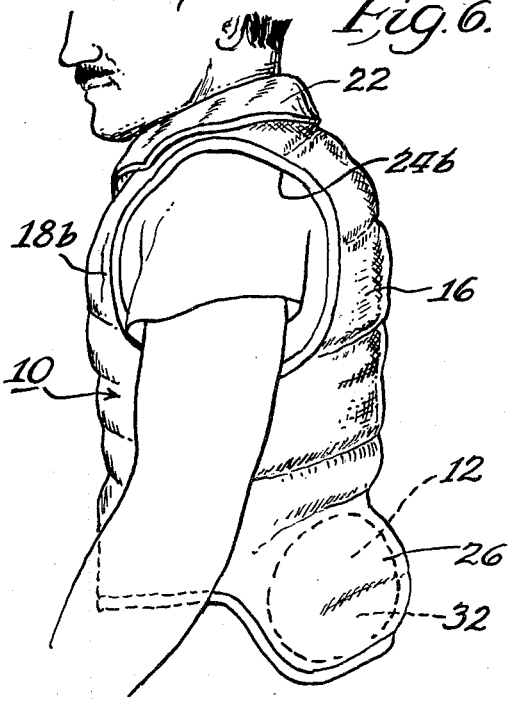
FIG. 6 is a side view thereof.

In FIGS. 3 and 4, the outer wear garment of the present invention is illustrated in its jacket and vest wearing mode. It can be seen that the wearer appears to be wearing a vest over a separate jacket. In FIGS. 5 and 6 the outer wear garment of the present invention is illustrated with the jacket portion tucked inside pocket 32. It can be seen that the wearer does not appear to be wearing or carrying any jacket. It can also be seen that when the jacket is within pocket 32, a well-insulated kidney extension flap 26 is provided.

Although an illustrative embodiment of the invention has been shown and described, it is to be understood that various modifications and substitutions may be made by those skilled in the art without departing from the novel spirit and scope of the present invention.

What is claimed is:

1. An outerwear garment which comprises:

a sleeveless vest for surrounding the upper body and comprising a back portion, a front portion and closure means for closing said front portion;

said back portion carrying a kidney extension flap at its lower end, said kidney extension flap having an interior portion defining a pouch;

a jacket for selectively surrounding the upper body and comprising a back jacket portion, a front jacket portion, a pair of sleeves and means for closing the front jacket portion;

the lower end of said jacket being connected to said vest adjacent said pouch, whereby said jacket portion may be inserted into said pouch or said jacket portion may be withdrawn from said pouch and the jacket sleeve may be inserted through side openings defined by said sleeveless vest.

2. A garment as described in claim 1, said sleeveless vest comprising an outer layer, an inner lining and filler material between said outer layer and inner lining.

3. A garment as described in claim 2, said outer layer and inner lining formed of one of the group consisting of nylon, cotton and a nylon-cotton mixture.

4. A garment as described in claim 3, said filler material comprising one of down and polyester.

5. A garment as described in claim 1, said jacket formed of one of the group consisting of nylon, cotton and a nylon-cotton mixture.

6. A garment as described in claim 1, said jacket further comprising a hood contiguous with said back jacket portion.

7. A garment as described in claim 1, the lower end of the jacket being connected to the vest generally above the kidney extension flap with the back of the kidney extension flap being contiguous with the back portion of the vest, and an inner kidney flap layer being connected to the lower end of the jacket to form said pouch which is defined by said inner kidney flap layer and the inside of the kidney extension flap.

8. A garment as described in claim 7, wherein the joint at the lower end of the jacket and the inner kidney flap layer is elastic.

9. A garment as described in claim 1, wherein the lower end of the jacket and the kidney extension flap are joined with elastic joining means, said elastic joining means forming a portion of the pouch opening.

10. A garment as described in claim 1, the lower end of said kidney extension flap comprising the bottom of said pouch.

11. An outerwear garment which comprises:

a sleeveless vest for surrounding the upper body and comprising a back portion, a front portion and closure means for closing said front portion;

a pouch defined by the lower interior of said back portion;

a jacket for selectively surrounding the upper body and comprising a back jacket portion, a front jacket portion, a pair of sleeves and means for closing the front jacket portion;

the lower end of said jacket being connected to said vest adjacent said pouch, whereby said jacket may be inserted into said pouch or said jacket may be withdrawn from said pouch and the jacket sleeves may be inserted through side openings defined by said sleeveless vest.

12. A garment as described in claim 11, wherein the lower end of the jacket and the lower interior of said vest back portion are joined with elastic joining means, said elastic joining means forming a portion of the pouch opening.

13. An outerwear garment which comprises:

a sleeveless vest for surrounding the upper body and comprising a back portion, a front portion and closure means for closing said front portion;

said vest having an outer layer, an inner lining and filler material between said outer layer and said inner lining;

said outer layer and inner lining formed of one of the group consisting of nylon, cotton and a nylon-cotton mixture;

said filler material comprising one of down and polyester;

said vest back portion carrying a kidney extension flap at its lower end, said kidney extension flap having an interior portion defining a pouch;

a jacket for selectively surrounding the upper body and comprising a back jacket portion, a front jacket portion, a pair of sleeves and means for closing the front jacket portion;

the lower end of the jacket being connected to the vest generally above the kidney extension flap with the back of the kidney extension flap being contiguous with the back portion of the vest, and an inner kidney flap layer being connected to the lower end of the jacket to form said pouch which is defined by said inner kidney flap layer and the inside of the kidney extension flap, the joint at the lower end of the jacket and the inner kidney flap being formed of an elastic material;

whereby said jacket may be inserted into said pouch or said jacket may be withdrawn from said pouch and the jacket sleeves may be inserted through side openings defined by said sleeveless vest.

* * * * *